US007583188B2

(12) United States Patent
Sawhney

(10) Patent No.: US 7,583,188 B2
(45) Date of Patent: Sep. 1, 2009

(54) SOFTWARE CONTROLLED ACCESS CONTROL DOOR CONTROLLER

(75) Inventor: Suresh Kumar Sawhney, Maharashtra (IN)

(73) Assignee: Ingersoll-Rand Company, Montvale, NJ (US)

( * ) Notice: Subject to any disclaimer, the term of this patent is extended or adjusted under 35 U.S.C. 154(b) by 261 days.

(21) Appl. No.: 11/574,070

(22) PCT Filed: Oct. 7, 2004

(86) PCT No.: PCT/IN2004/000311

§ 371 (c)(1),
(2), (4) Date: Feb. 22, 2007

(87) PCT Pub. No.: WO2006/025067

PCT Pub. Date: Mar. 9, 2006

(65) Prior Publication Data

US 2008/0094171 A1 Apr. 24, 2008

(30) Foreign Application Priority Data

Aug. 31, 2004 (IN) ..... 943/2004

(51) Int. Cl.
*G08B 29/00* (2006.01)

(52) U.S. Cl. ..... 340/507; 340/506; 340/514; 340/519; 340/572.1; 340/572.4; 340/572.8; 340/5.5; 340/5.61; 340/5.64; 709/219; 709/220

(58) Field of Classification Search ..... 340/507, 340/506, 514, 519, 572.1, 572.4, 572.8, 5.5, 340/5.61, 5.64; 709/219, 220
See application file for complete search history.

(56) References Cited

U.S. PATENT DOCUMENTS 6,422,463 B1 * 7/2002 Flink ..... 235/382
6,570,487 B1 * 5/2003 Steeves ..... 340/5.2
2002/0174357 A1 11/2002 Davis et al.

FOREIGN PATENT DOCUMENTS

CA 2360120 A1 4/2002
WO 0205220 A1 1/2002

* cited by examiner

*Primary Examiner*—Tai T Nguyen
(74) *Attorney, Agent, or Firm*—Michael Best & Friedrich LLP

(57) ABSTRACT

The present invention is an access control door controller which utilizes three relays, 16 alarm inputs, tamper switch, a Weigand reader, a RS 232 reader and a IP core module to enable access control alarm monitoring, inter locking of doors and/or energy management for a room with the help of a software. The present invention utilizes a distributed communication (peer to peer) thus creating a door access controller System network with a truly distributed intelligence permitting exchange of information between all controllers which may be situated in a single site or over multiple sites connected on a common network. The full system can be configured on the widely used TCP/IP network thus avoiding the need for extensive wiring traditionally required for Access Control System. The controller, with its associated software can support multiple types of readers and can directly interface IP cameras for an integrated TCP/IP based Access Control/CCTV Solution.

21 Claims, 2 Drawing Sheets

SOFTWARE CONTROLLED ACCESS CONTROL DOOR CONTROLLER

RELATED APPLICATIONS

This application is a National Phase Application of PCT Application No. WO 2006/025067, filed Oct. 7, 2004, which claims priority to Indian Application No. 943/MUM/2004, filed Aug. 31, 2004.

BACKGROUND

The present invention relates to an access control system. More particularly, the invention relates to an access control system including an access control door controller.

Traditional access control door controllers used in access control systems follow the RS 485 Protocol and use an RS 485 to RS 232 converter to communicate information to a server. Some access control systems use access control door controllers with RS 485 networks connecting various Access Control Doors through a single door, 2 door, 4 door, 8 door, 16 door or 32 door access control door controllers.

All these access control door controllers suffer from a few major limitations. Separate wiring needs to be done from the access control door controllers to each door for the systems which entails major civil work and leads to disruption of office work or postpones installation of an access control system until the next renovation. The existing access control systems also do not permit setting up of temporary access control areas as may be required in big offices to create security barriers between important projects, groups, or areas. Traditional access control systems allocate specific memory slots for user details, event logs etc. which can be stored in access control door controller.

Patent application no. WO 02/35479 uses a key system in conjunction with the door lock access controller mounted on each door. Patent application no. WO 00/60196 is for a dedicated Fingerprint Biometric Reader used to control access to any door. Patent application no. WO 03/098171 is directed to a monitoring and protection system which includes monitoring modules configurable with multiple alarms. This invention is primarily for use with vibration monitors/sensors and enabling vibration data.

SUMMARY

The invention relates to an access control system particularly to a door access controller which utilizes three relays, 16 alarm inputs, tamper switch, a Weigand reader, a RS 232 reader and an IP core module to enable access control alarm monitoring, inter locking of doors and/or energy management for a room.

In one construction, the invention provides an access control door controller removing the present limitations of a RS 485 networked Access Control Systems by utilizing its embedded software capabilities of recognizing and analyzing the information received simultaneously from both onboard Wiegand data port and RS 232 data port for read and write functions of RF identification devices thus bringing in a greater flexibility in use of varied RFID readers and operating all known Proximity and Smart Card protocols including but not limited to Wiegand, Mifare, Legic and i-CLASS and utilizing three relays being able to accept 16 alarms input from Sensors and control IP cameras utilizing a software which permits transferring of data from each individual controller working directly on the TCP/IP network to the server thus overcoming the major problem of using multiple door controllers having to use RS485 networks for wiring from individual doors to multiple door controller and operating on all known operating systems/relational data bases working with an independent power supply unit capable of meeting power supply requirements of IP cameras and alarm devices connected in conjunction with the door controller permitting full convergence of Access Control, CCTV and Alarm systems.

DETAILED DESCRIPTION

Figure 1:
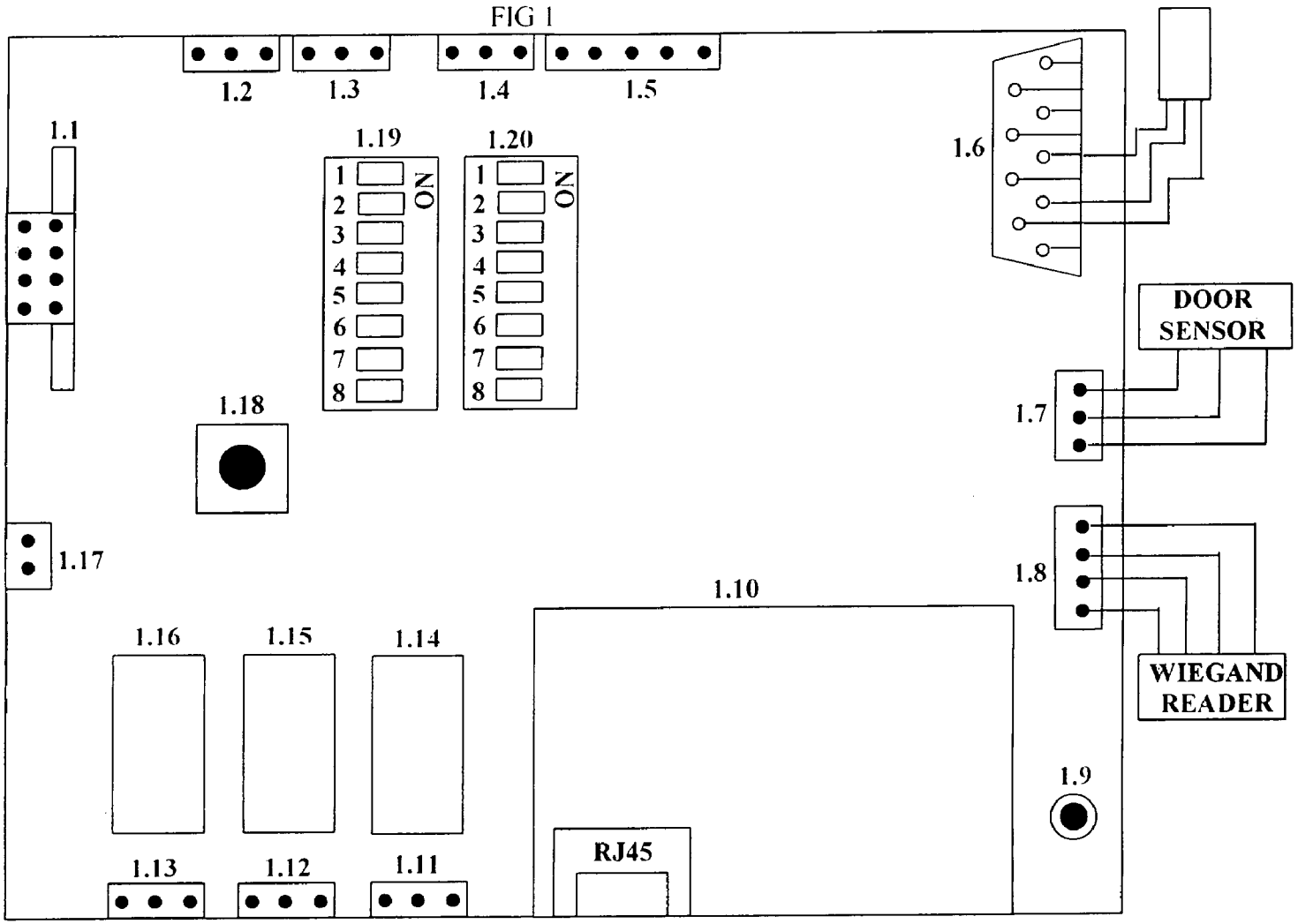
FIG. 1 illustrates the printed circuit board and its components of an access control door controller.

The following components are numbered as follows:

1.1 illustrates Power Connector From Power Supply

1.2 illustrates Power Connector For Various Purpose (CCTV Camera, IP Camera, Etc)

1.3 illustrates Power Connector For Various Purpose (CCTV Camera, IP Camera, Etc)

1.4 illustrates Power Connector For Various Purpose (CCTV Camera, IP Camera, Etc)

1.5 illustrates RS232 Port For Read Write Reader

1.6 illustrates RS232 Port For Read Write Reader

1.7 illustrates Door Sensor Connector

1.8 illustrates Weigand Reader Port

1.9 illustrates Power LED Indicator

1.10 illustrates TCP/IP Core Module With RJ45 Connector

1.11 illustrates Latch Connector

1.12 illustrates Latch Connector

1.13. illustrates Latch Connector

1.14 illustrates Relay For Various Other Functions

1.15 illustrates Relay For Various Other Functions

1.16 illustrates Relay For Door Action With Other Functions

1.17 illustrates Request To Exit Switch Connector

1.18 illustrates Tamper Switch

1.19 illustrates DIP Switch (Upper)

1.20 illustrates DIP Switch (Lower)

2.1 illustrates Main I/P 230 Volt Power Connector

2.2 illustrates Opto Isolator

2.3 illustrates Ac Module

2.4 illustrates Battery Contact

2.5 illustrates Output Voltage Connector

2.6 illustrates Power Reset Switch

The invention pertains to an access control door controller with its associated software which is capable of working in multiple operating system environments. The access control door controller is capable of accepting one way communication inputs in the Weigand mode with an inbuilt capability of 2 way communication in the RS 232 mode. The access control door controller is fully integratable with IP cameras by providing local power to the camera and controlling the IP camera through its logically controlled relays. An integrated power supply with an inbuilt battery back up ensures continued access control even in the case of a power failure and does away with the need of running power lines for use with IP cameras, door strikes, and door switches, whilst utilizing the well known and widely prevalent TCP/IP network capabilities. The associated software is operating system and database compatible to all systems.

With the use of TCP/IP networks and minimal local wiring from the access control door controller to the EM lock and associated reader, the access control system does away with all the above limitations. With the integration of wireless Local Area Network (LAN), the access control door controllers provide total flexibility in use of Access control system, including setting up of temporary secure areas. This system utilizes a communication network similar to RS485, which is a dedicated communication network laid specifically for this system. The controller for access control doors does not require a dedicated communication network. The controller uses the existing LAN for communicating between controllers installed on each door, thus leading to an extremely cost effective, novel way of networking from door to door with minimal loading on the infrastructure. A dynamic memory management in the access control door controller does away with the drawbacks of the fixed memory allocation blocks.

The access control door controller of the present invention is able to utilize any of the biometric systems in the market, including fingerprint, hand geometry, face recognition etc., thus making it more versatile and useable in any of the possible locations without limiting it to a particular type of reader. The controller for access control doors utilizes the universal Weigand and RS232 inputs which enables it to be interfaced with any type of biometric readers.

The present invention makes use of the RS 232 reader as it gives two way communication as well as enables financial transactions to be performed as it works in conjunction with a specific software. The controller can also be interfaced with smart cards, thus making it an extremely cost effective solution in expanding the smart card world market.

The present invention, which is a controller for access control doors, has the capability of accepting up to sixteen alarms from various sensors, including glass break detectors, laser detectors, smoke detectors, vibrations detectors etc. as sixteen alarm inputs are installed on the printed circuit board. By utilizing these alarms, the controller can trigger the desired action through its on board relays, which can control doors, activate other devices, like air conditioners, on an as required basis.

With reference to FIG. 1, three relays 1.14, 1.15, 1.16 are installed on the Printed Circuit Board which imparts a designed capability of interlocking doors as well as locking and unlocking of doors. By interlocking of doors it is meant that if one door is open the other door which forms a pair cannot be opened. An additional relay parallely permits the opening and closing of a third access controlled door. Thus a single access control door controller can control three doors simultaneously; two doors for interlocking and one for controlled entry and exit. The access control systems in prior art allow only one entry and exit door. The function of the relays is to open and close contacts for controlling the power supply to electrical strikes and/or sensors/cameras/any device utilizing the input power supply to the relay. (A 12 volt input through a single relay enable 12 volts output.)

There are sixteen alarm inputs which can be used for alarm control. The alarm inputs are installed on the Printed Circuit Board by expanding the designed input/output points on the access control door controller circuit. The access control door controller can expand its capability to individually accept identification alarm inputs from 16 sensor sources. The sensors could be door switches, heat sensors, smoke sensors, movement sensors, glass break sensors, flooding switches, temperature rise detectors, beam detectors, etc.

A Weigand reader 1.8 as well as a RS 232 1.5, 1.6 serial communication reader can be connected to the access control door controller at the same time. A weigand reader is a one way reader which using the weigand security protocols, converts the identification information of the cards into a code and is read by the access control door controller for translation of the information for further use in the associated software. The weigand code is of international standards and building in the compatibility makes the access control door controller versatile enough to be used as a retrofit for any organization using the weigand readers. The RS 232 readers for security purposes are less prevalent than the weigand readers in the security market. This is because the RS 232 protocol is a non secure, open protocol. RS 232 is a communication protocol for connecting modems and data acquisition devices to computers. RS 232 devices can be plugged straight into the computer's serial port. However because of its simplicity some companies offer security systems using the RS 232 protocol for the readers of the systems, though only in a one way communication mode much like the weigand mode.

The present invention is able to use either Weigand based readers or the RS 232 based reader or both at the same time that means both the weigand and the RS 232 readers are installed on one single access control door controller. The RS 232 readers are specifically required when a two way communication is important like in smart cards; card based financial solutions or transactions. In such solutions the information can first be read from the smart card, analyzed as required and the modified information can be written back on the same card. One of the simple applications of the present invention would be in a canteen or cafeteria or a payroll application both utilizing the electronic pulse capability of smartcards The access control door controller can be connected on a TCP (transmission control protocol)/IP (internet protocol) network with the help of a TCP/IP core module 1.10. The access control door controller while making use of such a core module converts the signals from the access control door controller Local Area Network language to the TCP/IP Local Area Network language. TCP/IP is a universal Local Area Network language for computer networking and internet.

A secured Local Area Network language protocol is used for communication from the access control door controller to the access control server (i.e. nobody can interrupt or trap the data in between and use it). The date on a secured Local Area Network language protocol is transferred from the access control door controller to the access control server in an encrypted format.

Integrated door sensors are installed on the doors to enable the access control door controller to know the actual status of the door in real time. There is one sensor connected on each access control door controller, which is installed on the physical door to get the status of the door on line on the access control server. The door sensor senses the condition of the door and forwards the data to the access control door controller through a door sensor connector 1.7. The access control door controller transmits the data to the Access Control server which will reflect the information on the display of the Access Control server.

Fail safe/fail secure strikes can be connected. Fail safe means if the entire system fails the door can be manually opened e.g. in a fire condition the emergency exit can be made if fail safe latches are installed on the door. Fail safe latches thus allow an emergency exit while fail secure latches do not allow emergency exit that means fail secure latches require an additional emergency device to open the door in case of emergency. These latches are required for secure areas.

An inbuilt tamper alarm switch 1.18 has been designed to retrieve tamper information on the Access Control server screen. Tamper alarm switch is connected on the printed circuit board of the access control door controller and gets activated if somebody is tampering with the access control door controller. There is a spring attached between the tamper switch and the access control door controller body cover. There is a cover installed on the entire printed circuit board. If anybody tries to meddle/fidget with the cover, the spring pressure of the spring gets released thereby actuating the tamper alarm switch.

Real Time Clock Batteries permit storage of essential information on board the Access Control door controller for a few hours after the main power and the standby battery fail.

The Switch Identification number switch physically assigns an independent identification number to the access control door controller by the user. This helps the access control door controller to identify itself on a large TCP/IP network to communicate with a specific Access Control server software. The number is configured with the help of binary dip switches 1.19, 1.20 on the access control door controller. The switch indicates a binary number and it forwards to the access control server software a second level of identification i.e. after getting Internet Protocol address identification.

This helps the access control server to forward the information to the appropriate access control door controller. To set the binary number the user needs a 16 bit code which is divided into two dip switches 1.19, 1.20 i.e. from 1 to 8 and second from 9 to 16. These dip switches are installed on the printed circuit board. The 1 to 8 dip switch is known as the upper door control unit address and 9 to 16 is known as the lower door control unit address. This ensures a much higher level of security especially in a multi city multi office environment where a common TCP/IP network is in use.

The Request to Exit switch 1.17 permits opening of the door from the inside without having to use contact less RF Identification Weigand/RS 232 ports. Contact less RF Identification cards are those, which transmit an identification number from a distance without any contact.

The integrated power supply Board used with the access control door controllers is designed to provide 12 volts and 5 volts system voltages which are required for the functioning of the access control door controllers as also other accessories like IP cameras, sensors, electromagnetic strikes with its Nickel Cadmium batteries or metal hydrate batteries through associated power connectors 1.2, 1.3, 1.4. The Access Control door controller's integrated power supply can withstand any power failure for the areas it is utilized for without being dependent upon the incoming power supply.

Figure 2:
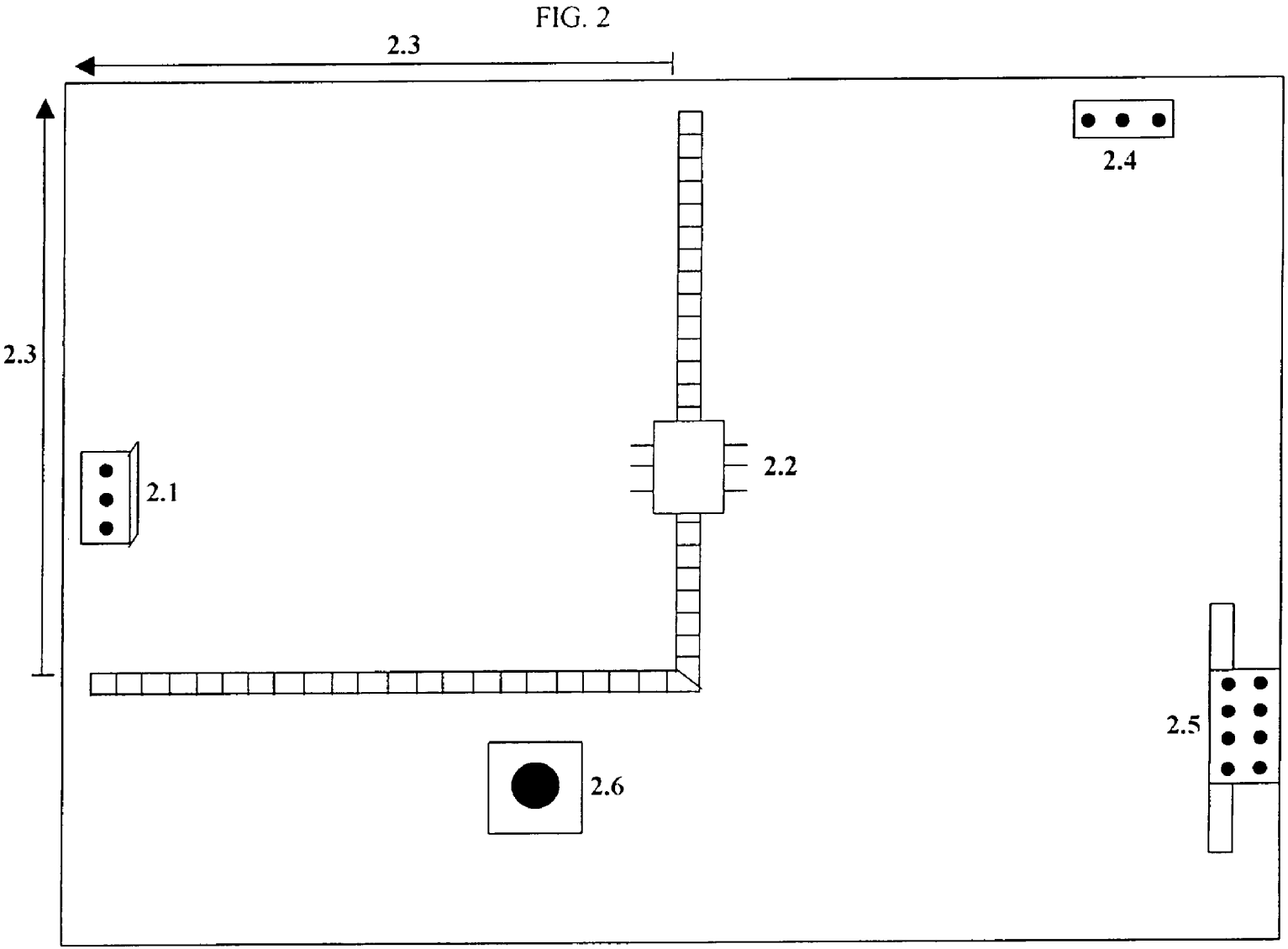
FIG. 2 illustrates the integrated power supply board of the access control door controller.

The integrated power supply board comprises of the following components, as illustrated in FIG. 2.

The input AC module 2.3 accepts power from 90 volts to 260 volts through main power connector 2.1, thus making it a universal power supply, which can be used without any adaptors.

Opto-Isolators 2.2 isolate the AC module from the DC converting module. This ensures that any surge or lightening strike on the AC side will not in any way hamper the DC output essentially generated for the Access Control Door controller.

The battery connectors 2.4 connect the Nickel Cadmium or Metal Hydrate batteries to the power supply thus allowing them to be charged when the AC is available.

The invention includes a software shutdown reset switch 2.6. This permits the DC supply through output voltage connector 2.5 to the Access control door controller to be switched off, when commanded to do so by the software. This switch needs to be manually reset when the access control door controller comes online again.

Output relays switch between the DC available being provided from the AC input vis-a-vis that provided when the battery takes over on failure of the AC.

Latch connectors 1.11, 1.12, 1.13 (see FIG. 1) provide the necessary pulse based upon the information available from the software which works in conjunction with the access control door controller. The command to an electrical latch on which the door is to be opened is conveyed by a latch connector in the form of either applying the voltage across the latch coil or removing the voltage.

Static IP addresses as well as dynamic IP addresses can be given to the access control door controller. Static IP address can be user selected for being allocated to each access control door controller. There is a server in the access control door controller which can be turned on or off. If the server is on then it automatically asks for the access control server internet protocol address (IP address) and starts communication to the access control server. If the access control door controller gets reset it will again query the access control server and ask for an internet protocol address i.e. IP address which will help the access control door controller for further communication with the access control server. If the server is off then the access control door controller needs to be configured/programmed for a dedicated IP address for the access control door controller with the access control server software IP address.

This capability of the access control door controller imparts it capability of carrying out multi site control and survey local Area Network, from any designated computer in a worldwide network. The head office of a large organization, where the major installation for the system would be done, can use the dynamic IP address capability for large number of access control door controllers used in the head office while the other branches can use the static IP assignment capabilities. This would prevent clash of IP address in case of a network failure and rebooting of the same.

The basic working principle of the access control door controller is that when the access control door controller is installed for controlling the access on any door, the complete access data of all the users permitted to use the door is stored on the access control door controller. Thus when an authorized user shows the RF Identification card on the reader, the access control door controller compares the data with that available with it and, if the user is authorized, gives the command which allows the door to be opened. After every activity the access control door controller sends the activity report to the access control server for display or recording.

The three relays which are installed on the access control door controller perform multiple tasks or functions. One of the functions that can be performed by the present invention is indication as well as regulation of temperature in a room. Two sensors (standard electronic thermometers) work in conjunction with these relays. These sensors along with the relays regulate the temperature of the room. If the temperature of the room is indicated as hot or warm by the thermometer the same signal is communicated to the designated relay which then switches on the air conditioner which leads to the lowering of the temperature of the entire room. The second sensor (another electronic thermometer) detects the already cooled down temperature and conveys the same signal to the designated relay. This relay then enables the Air Conditioner to be switched off thereby preventing further lowering of the temperature of the room. The cycle continues as the temperature rises.

In the traditional access control systems central power supply is used for supplying necessary power to a set of doors. To circumvent the problem of all doors failing in case of failure of power supply, an integrated power supply has been designed specifically for the purpose of ensuring that a group of doors do not become inoperable due to failure of the central power supply. The additional power supply requirements of the associated equipments like close circuit, television cameras, IP cameras, triggering sensors etc. are also met from the integrated power supply of the access control door controller.

The invention pertains to a versatile access control door controller with its associated software which is capable of working in multiple operating system environments. An operating system is a dynamically run systems which functions on the computer. The operating system is a platform like Windows, Windows 2000, Windows XP, DOS Linux etc. Typically all access control systems work either on Windows operating systems or on DOS operating systems. The present invention can work on Windows and on DOS as well as on Unix, Linux etc. Thus the present invention can work on multiple operating system. This implies that the operation of the present invention is not constrained by operating systems which the user is using. This becomes critical as there are a number of organizations who do not use Windows which is the preferred operating system for most of the existing Access Control Systems. This has special reference to many governments and organizations who are switching to a more cost effective and less virus prone Linux system. Some of the highly professional organizations like to use Unix. The onboard software on the access control door controller makes it possible for the present invention to function in multiple operating systems. In addition, the system can work with any database SQL, Oracle, My SQL etc. Thus the present invention can work with multiple databases.

The traditional Access Control System's need for creating and wiring an additional RS 485 network is totally eliminated. In addition, the latest technology of wireless Local Area Network is fully utilized to impart a versatility in the system of creating temporary access control points, a need for which is extensively felt in the corporate world today with no available systems to fill this need. The system does away with a need for door to door or, door to access control door controller cabling which is a pre requisite for traditional access control systems. The maximum number of access control door controllers the system can support is more than 65,000 as controlled from any Local Area Network mode. For smaller organizations, systems as small as 1 door system can be configured.

The facility of totally doing away with the wiring for RS 485 network is achieved by utilizing the TCP/IP protocol which runs on the now universal Local Area Network which already exists in offices. The same wiring can be used for access control security systems. The RS 485 network works only with computers connected by suitable wires and cables in the range of 1.2 Kms. The present invention makes use of the TCP/IP network which can be an internet connection or a Local Area Network based system network. Therefore the present invention eliminates the need of a special RS 485 network only to run and use an access control system.

With its Weigand and RS 232 serial communication interface, the access control door controller can use virtually any card readers in the market and thus can upgrade/add to any existing Access Control System with minimum of disruption. With necessary safe guards, the system can be remotely controlled over the internet with full access to all functions of the access control door controller. The access control door controller has all the required DC voltage outputs which may be required for external devices like IP cameras, electrical latches etc.

I claim:

1. An access control system that controls access to a plurality of areas by controlling a door associated with each area, the access control system comprising:

a server;

a plurality of devices, each device operable to sense a signal and output an alarm signal in response to the sensed signal;

a first reader positioned adjacent a first door and operable to receive first data from a first user at a first time;

a second reader positioned adjacent a second door and operable to receive second data from a second user at a second time; and an access control door controller including:

a processor operable to run software;

a plurality of alarm inputs each alarm input operable to receive the alarm signal from a corresponding one of the plurality of devices;

a first data port operable to receive the first data and forward the first data to the processor at a third time;

a second data port operable to receive the second data and forward the second data to the processor at a fourth time;

a communication module operable to communicate with the server; and a plurality of relays, each relay operable to receive an instruction signal from the processor, based at least partially on the first data and the second data, and each relay further operable to send an actuation signal in response to the instruction signal.

2. The access control system of claim 1, wherein the plurality of relays are operable to interlock a plurality of doors.

3. The access control system of claim 1, wherein the plurality of relays are operable to interlock at least two of a plurality of doors and operable to separately control at least one of the plurality of doors.

4. The access control system of claim 1, wherein the plurality of relays is operable to control a temperature of a room.

5. The access control system of claim 1, wherein at least one of the plurality of devices is a camera and the access control door controller is further operable to receive video from the camera.

6. The access control system of claim 1, wherein the software is operable to receive each of the alarm signals, process the received alarm signals into archive data, and communicate the archive data to the server.

7. The access control system of claim 1, wherein the first data port is further operable to send third data to the first reader, and wherein the second data port is only operable to receive data.

8. The access control system of claim 7, wherein the first data port is an RS 232 port and the second data port is a Weigand reader.

9. The access control system of claim 1, wherein the first time and the second time are substantially equal.

10. The access control system of claim 1, wherein the third time and the fourth time are substantially equal.

11. The access control system of claim 1, wherein access control door controller further includes a transmitter, the transmitter operable to communicate wirelessly with the server.

12. The access control system of claim 1, wherein the software is operable to function on a plurality of operating systems.

13. The access control system of claim 1, wherein the software is operable to function with a plurality of databases.

14. The access control system of claim 1, wherein the communication module is a TCP/IP core module and the TCP/IP core module is operable to communicate with the server over a local area network connection.

15. The access control system of claim 1, wherein the access control door controller further includes a power supply module operable to supply a first voltage to the access control door controller and a second voltage that is different from the first voltage to at least one of the plurality of devices.

16. The access control system of claim 1, further including a first locking mechanism positioned adjacent the first door and a second locking mechanism positioned adjacent the second door, and wherein the plurality of relays includes a first relay operable to send a first actuation signal to the first locking mechanism to control access to the first door, and a second relay operable to send a second actuation signal to the second locking mechanism to control access to the second door.

17. An access control door controller configured to retrofit to a security system in a building that includes a control server, a first identification reader positioned adjacent a first access point, a second identification reader positioned adjacent a second access point, and a plurality of monitoring devices, the access control door controller comprising:

a processor configured to run software, the processor including a memory that stores user data;

a plurality of inputs each input configured to receive an information signal from one of the plurality of monitoring devices and forward the information signal to the processor;

a first data port configured to receive a first identification signal from the first identification reader and forward the first identification signal to the processor at a first time;

a second data port configured to receive a second identification signal from the second identification reader and forward the second identification signal to the processor at a second time, the processor configured to receive the first and second identification signals and compare the first and second identification signals to the user data to make an access decision and output a first actuation signal and a second actuation signal based at least partially on the comparison, the processor also configured to produce an update message and transmit the update message wirelessly to the control server;

a first relay configured to receive the first actuation signal and forward the first actuation signal to a first locking mechanism positioned adjacent the first access point to control user access thereto;

a second relay configured to receive the second actuation signal and forward the second actuation signal to a second locking mechanism positioned adjacent the second access point to control user access thereto; and a wireless communication module configured to receive the update message from the processor and wirelessly transmit the update message to the control server.

18. The access control door controller of claim 17, further including a power supply module configured to receive an AC power from a main power source and convert the AC power into a first DC power at a first voltage and a second DC power at a second voltage that is different from the first voltage, the power supply module configured to supply the first DC power and the second DC power to the access control door controller.

19. The access control door controller of claim 18, wherein the access control door controller provides the first DC power to the first identification reader and the second identification reader, and the second DC power to the plurality of monitoring devices.

20. The access control door controller of claim 17, wherein the first data port is an RS 232 port, and the second data port is a Wiegand reader.

21. The access control door controller of claim 17, further comprising a third relay, and wherein the processor is configured to output a third actuation signal based on the access decision, the third relay configured to receive the third actuation signal and forward the third actuation signal to a third locking mechanism positioned adjacent a third access point such that user access to the third access point is controlled by one of the first identification signal and the second identification signal.

* * * * *